US008528226B2

(12) United States Patent
Bache et al.

(10) Patent No.: US 8,528,226 B2
(45) Date of Patent: Sep. 10, 2013

(54) VENTED DRYER HAVING COUNTER-FLOWING AIR AND METHOD FOR THE OPERATION THEREOF

(75) Inventors: Kai-Uwe Bache, Berlin (DE); Philipp Steusloff, Berlin (DE); Andy Wischer, Kamern (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 418 days.

(21) Appl. No.: 12/988,342

(22) PCT Filed: Apr. 8, 2009

(86) PCT No.: PCT/EP2009/054246

§ 371 (c)(1),
(2), (4) Date: Oct. 18, 2010

(87) PCT Pub. No.: WO2009/132942

PCT Pub. Date: Nov. 5, 2009

(65) Prior Publication Data

US 2011/0041353 A1 Feb. 24, 2011

(30) Foreign Application Priority Data

Apr. 29, 2008 (DE) ..... 10 2008 021 376

(51) Int. Cl.
*F26B 11/00* (2006.01)

(52) U.S. Cl.
USPC ..... 34/381; 34/413; 34/595; 34/606; 34/610; 68/5 R; 68/18 R; 62/186; 236/49.3

(58) Field of Classification Search
USPC ..... 34/380, 381, 413, 197, 595, 218, 34/601, 606, 610; 68/5 R, 18 R; 62/186; 236/49.3
See application file for complete search history.

(56) References Cited

U.S. PATENT DOCUMENTS

| | | | | |
|---|---|---|---|---|
| 2,873,539 | A * | 2/1959 | Morey | 34/597 |
| 3,034,221 | A * | 5/1962 | Tuck et al. | 34/527 |
| 3,106,831 | A * | 10/1963 | Behrens | 68/12.08 |
| 4,757,699 | A * | 7/1988 | Arreghini et al. | 68/16 |
| 5,555,645 | A * | 9/1996 | Joslin | 34/499 |
| 6,158,148 | A | 12/2000 | Krausch | |
| 6,751,888 | B2 * | 6/2004 | Lueckenbach | 34/595 |
| 6,868,621 | B1 * | 3/2005 | Grimm et al. | 34/92 |
| 2005/0241326 | A1 * | 11/2005 | Yoong et al. | 62/186 |
| 2007/0039198 | A1 | 2/2007 | Boettcher et al. | |
| 2007/0062513 | A1 * | 3/2007 | Gagas | 126/299 D |

(Continued)

FOREIGN PATENT DOCUMENTS

| | | | |
|---|---|---|---|
| DE | 442250 | A1 | 5/1996 |
| EP | 1995371 | A1 * | 11/2008 |
| JP | 2004181151 | A | 7/2004 |

*Primary Examiner* — Steve M Gravini
(74) *Attorney, Agent, or Firm* — James E. Howard; Andre Pallapies

(57) ABSTRACT

A vented dryer having a drum to dry damp laundry by warm process air; a first process air duct upstream of the drum; a heater to heat the process air in the first process air duct; a supply air duct leading into the first process air duct; an exhaust air duct; a second process air duct downstream of the drum and transitioning into the exhaust air duct; a blower; a first temperature sensor in the first process air duct; and a heat-buildup generator to generate a heat buildup at the first temperature sensor if a counter-flowing air current occurs.

14 Claims, 2 Drawing Sheets

(56) References Cited

U.S. PATENT DOCUMENTS

2008/0127505 A1 6/2008 Han et al.
2009/0229141 A1* 9/2009 Nawrot et al. ..... 34/467
2010/0154248 A1* 6/2010 Stolze ..... 34/493
2011/0041353 A1* 2/2011 Bache et al. ..... 34/218

* cited by examiner

VENTED DRYER HAVING COUNTER-FLOWING AIR AND METHOD FOR THE OPERATION THEREOF

BACKGROUND OF THE INVENTION

The invention relates to a vented dryer having counter-flowing air detection, i.e. detection of an airstream flowing in the opposite direction to the flow direction provided for normal operating conditions (counter-flowing air current), and to a method for the operation of said vented dryer.

In a dryer, in particular a laundry dryer, articles to be dried, in particular laundry, contained in a generally rotating drum are dried by conducting through the drum, and consequently through the articles to be dried, a heated current of air which extracts moisture from the articles to be dried, as a result of which the said damp laundry articles are gradually dried.

The supplied air current ("process air flow") is heated in a supply line (supply air duct or, in this case, "first process air duct") upstream of the drum (in the case of a laundry dryer also "laundry drum") by means of a heating device and after passing through the drum is either discharged to the outside (exhaust air or vented dryer) or conveyed to a heat exchanger in which the air current is cooled down and the moisture extracted from the articles to be dried and entrained in the air current precipitates out as condensate. Hybrid forms hereof are likewise known. A blower (process air blower) is generally used for conveying the air.

In a vented dryer, the moist, warm air coming from the drum is conveyed through an exhaust air outlet into the room where the dryer is installed or via an exhaust air system into the open air. Depending on the weather conditions, in particular the wind conditions, it can happen that air is forced into the vented dryer via the exhaust air outlet. This can lead to a malfunctioning of the system that is typically present in the vented dryer as a protection against overheating. That is to say that in order to protect against overheating there is normally disposed in a vented dryer a temperature sensor or temperature limiter which is positioned in the flow direction of the process air downstream of the heating device and upstream of the drum and which can turn off the heating device if overheating is detected in the vented dryer. If the air flow provided for normal operating conditions is disrupted due to an infiltration of air (counter-flowing air) and the process air flows in a direction opposite to the intended direction, air heated by the heating device can flow in the opposite direction, i.e. away from the drum. This hot air can flow into a supply air duct or, if present, into a recirculated air duct. Usually there is lint present in the recirculated air duct, so under very unfavorable conditions there may be an increased risk of fire. In any case a hot air current in the opposite flow direction can lead to malfunctions and is therefore undesirable.

A second temperature sensor or temperature limiter is generally necessary at the present time in order to prevent overheating of the vented dryer in the event of the occurrence of an air current flowing in the opposite direction.

BRIEF SUMMARY OF THE INVENTION

The object of the invention is therefore to provide a vented dryer that allows reliable detection of an occurrence of a counter-flowing air current during the operation of the vented dryer.

This object is achieved according to the invention by a vented dryer and by a method having the features recited in the respective independent claim. Advantageous embodiments of the inventive vented dryer and the inventive method are set forth in corresponding dependent claims.

The invention therefore relates to a vented dryer having a drum for drying articles to be dried by means of warm process air, a heating device for heating the process air in a first process air duct upstream of the drum, into which process air duct a supply air duct leads, a second process air duct disposed downstream of the drum and transitioning into an exhaust air duct, a blower, and a first temperature sensor in the first process air duct, the vented dryer having a device for generating a heat buildup at the first temperature sensor if a counter-flowing air current occurs.

The term "temperature sensor", as used in the present context, is to be interpreted in a broad sense. It includes, for example, any temperature sensor that simply measures a temperature value and forwards said temperature value to a suitable processing device, for example a program controller of the vented dryer. A temperature sensor within the meaning of the invention is also a sensor device of a type which can initiate an action, interrupting an electric circuit for example, as the result of the measurement of a temperature value, without having to make a detour via a process controller. A sensor device of this kind is generally referred to as a "temperature monitor". A temperature monitor can consist, for example, of a thin bimetallic plate which suitably deforms when there is a change in temperature and, in particular when a specific upper temperature limit value is reached, can interrupt an electric circuit by actuating a correspondingly associated switch.

In a preferred embodiment variant of the vented dryer the device for generating a heat buildup is disposed between the heating device and the drum.

Preferably the device is disposed between the first temperature sensor and the drum.

The first temperature sensor is generally used for detecting a heat buildup. In a preferred embodiment variant a distance between the device and the first temperature sensor is therefore in the range from 1 to 15 cm, in particular from 2 to 10 cm.

The device is preferably a flap device. Generally said flap device changes its position as a function of the direction of an air current in the first process air duct.

The term "flap device" is to be interpreted in a broad sense. In particular the term "flap device" means that it is a device which can assume different positions in the first process air duct which manifest themselves in a greater or lesser obstruction of an air current in the first process air duct.

Accordingly, the shape and arrangement of the flap device are not limited as long as the purpose of the present invention is served. For example, the flap device can be an essentially flat, pivoted thin plate. At one of its ends, at which it is disposed for example on a wall of the first process air circuit or at the first temperature sensor, the flap device can have a shape appropriate to the arrangement. The flap device will generally be disposed in the vented dryer by way of a suitable connection which permits a possibly necessary pivoting of the flap device, for example a hinge mechanism.

The flap device is preferably mounted by means of a hinge or spring mechanism on a wall of the first process air duct or at the first temperature sensor. More preferably, the flap device is mounted by means of a hinge mechanism on the wall of the first process air duct or at the first temperature sensor.

In a hinge mechanism, a flat thin plate, for example, can be suitably bent at one end in order to form a hinge at a wall of the first process air duct or at the first sensor in conjunction with a retaining device, in particular an arrangement consisting of a lug or a plurality of lugs. The device, in this case the flat thin plate, is thus mounted on the wall or at the sensor so as to be rotatable.

The shape of the device may be different from a flat thin plate.

According to the invention, the presence of a single device in the vented dryer is generally sufficient. However, the use of two or more devices for generating a heat buildup when a counter-flowing air current occurs can be provided in embodiment variants.

The change in position of the device in the first process air duct as a result of a varying air flow, which can also be described as a deflection of the device, is preferably chosen such that the device, in particular the flap device, can return to its previous position in the event of a reversal in the flow direction of the air in the first process air duct. Preferably an angle which the device, in particular the flap device, can form with the flow direction of the air is therefore suitably limited.

According to the invention, the possibility of generating a heat buildup by means of the device when a counter-flowing air current occurs is important. For this purpose it is not necessary for an air flow in the first process air duct to be interrupted completely. Preferably, therefore, the device, in particular the flap device, does not completely close the first process air duct in an open, in particular in a hinged-out, state.

In a preferred embodiment variant, a second temperature sensor is present in the vented dryer according to the invention. Using a second temperature sensor which, where appropriate, may likewise be combined with a further device for generating a heat buildup increases the operating reliability of the vented dryer. A second temperature sensor is preferably connected to a program controller of the vented dryer.

The vented dryer according to the invention can be operated as a straightforward vented dryer in which the total volume of moist, warm process air exiting the drum can be conducted as exhaust air into the room in which the dryer is installed. Preferably, however, the vented dryer according to the invention is operated with a proportion of recirculated air.

In a preferred embodiment variant of the vented dryer according to the invention, a first end of a recirculated air duct therefore leads into the first process air duct and a second end of the recirculated air duct leads into the second process air duct.

The concentration of lint in the process air coming from the drum can be reduced by means of one or more suitable lint filters. In this context the term "lint filter" is to be interpreted in a broad sense. For example, it also includes a heat exchanger (condenser) in which the moist, warm air exiting the drum, which air is furthermore loaded with lint, is cooled through exchange of heat with a suitable cooling medium (supply air or, as the case may be, cooling air in an optionally present air-air heat exchanger; coolant in the evaporator of an optionally present heat pump) and moisture contained in the process air condenses. The moist condenser can act as a kind of lint filter. Furthermore, nets having different mesh sizes can also be employed as lint filters. It is preferred according to the invention for the vented dryer in the embodiment variant having a recirculated air duct to have a lint trap in the recirculated air duct.

The vented dryer according to the invention can be operated with or without a heat exchanger for condensing the moisture contained in the warm process air after the latter has passed through the drum.

According to the invention, an occurrence of a counter-flowing air current is preferably indicated in the form of an optical and/or acoustic signal. For that purpose an acoustic signal indication, for example, could be used as the indicating means, such as e.g. one or more transmitters having different noises or tones, or a voice synthesizer having a message such as e.g. "counter-flowing air" or "overheating". Corresponding information can also be communicated via an optical signal indication (LED or LCD).

In a preferred embodiment variant, the vented dryer therefore has indicating means for signaling an occurrence of a counter-flowing air current.

A further object of the invention is a method for operating a vented dryer having a drum for drying damp laundry by means of warm process air, a heating device for heating the process air in a first process air duct disposed upstream of the drum and into which a supply air duct leads, a second process air duct disposed downstream of the drum and transitioning into an exhaust air duct, a blower, a first temperature sensor in the first process air duct, and a device for generating a heat buildup if a counter-flowing air current occurs, wherein upon the occurrence of a counter-flowing air current from the drum in the direction of the heating device the device obstructs an air flow in the first process air duct and generates a heat buildup at the first temperature sensor.

With said method it is preferred that when a predefined maximum temperature value $T_{max}$ is reached, the first temperature sensor switches off the heating device and/or signals the occurrence of a counter-flowing air current with the aid of an indicating means. The predefined temperature value $T_{max}$ is suitably specified as a function of factors such as, for example, the distance of the first temperature sensor from the device, the location of the arrangement of the second temperature sensor, and/or the embodiment of the air paths (first and second process air duct, recirculated air duct, etc.).

Preferably the first and, if present, a second temperature sensor are connected to a program controller of the vented dryer.

The vented dryer according to the invention has the advantage that an occurrence of a counter-flowing air current can be reliably detected, at which point suitable countermeasures, such as in particular switching off the heating of the vented dryer, can be initiated automatically or by a user of the vented dryer. By virtue of the invention the use of a second temperature sensor is rendered superfluous.

BRIEF DESCRIPTION OF THE DRAWINGS

Further details of the invention will emerge from the following description of a non-limiting exemplary embodiment with reference to FIGS. 1 to 3, in which.

DETAILED DESCRIPTION OF EXEMPLARY EMBODIMENTS OF THE PRESENT INVENTION

Figure 1:
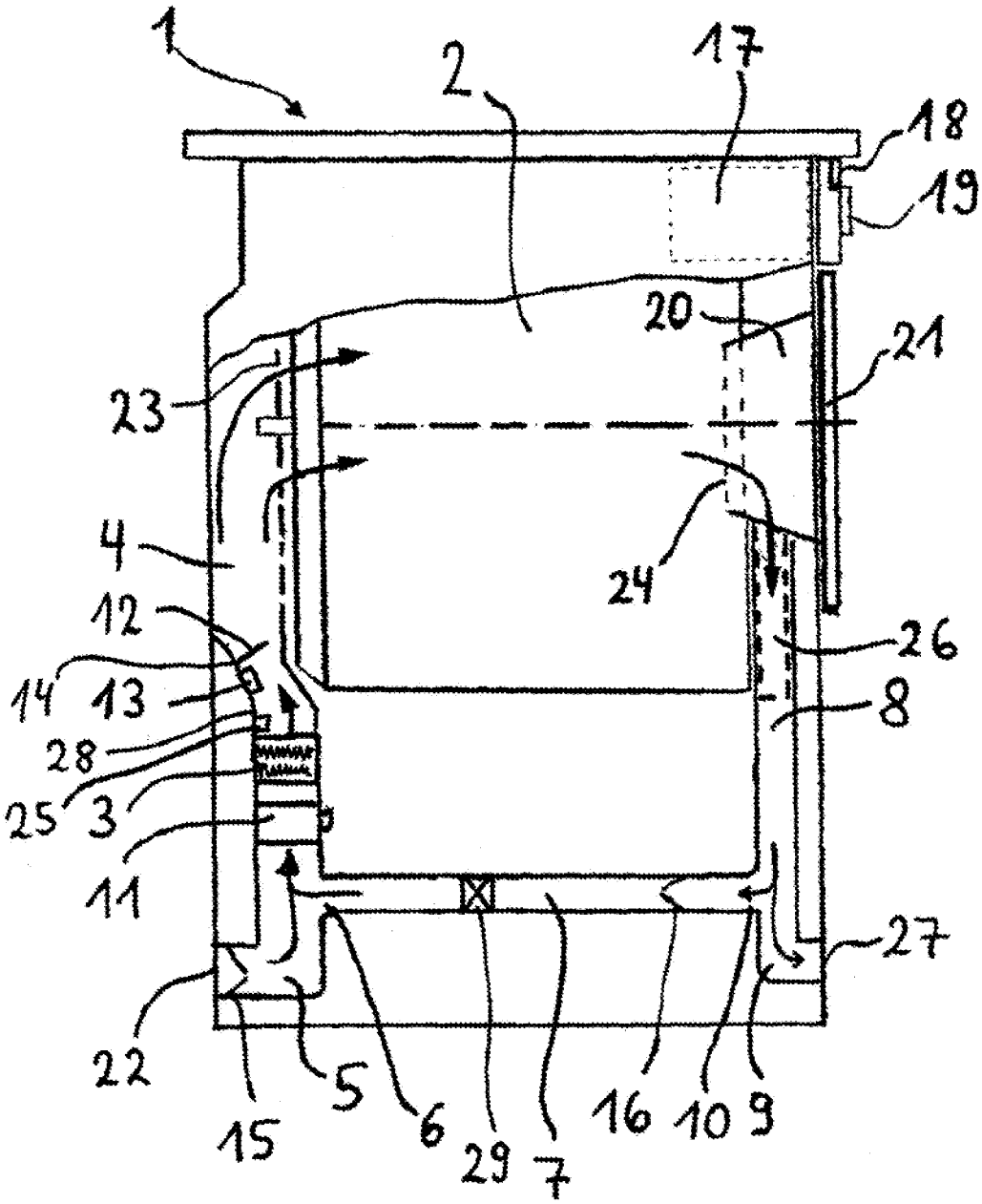
FIG. 1 shows a vented dryer in a partial sectional view.

FIG. 1 shows a partial sectional view of a vented dryer 1. In its top part the latter has a program controller 17 which can be set by an operator control element 19 and preferably can include a fuzzy processor controller (not shown here). Reference numeral 18 denotes an optical or acoustic indicating means for signaling various states of the vented dryer 1, in particular the occurrence of a counter-flowing air current.

The vented dryer 1 has a drum 2 which is accessible via a barrel 20 from a loading door 21 and via which laundry items requiring drying can be introduced into the drum 2 and removed from it again.

Present at the rear of the vented dryer 1 is a supply air opening 22 into which air can be aspirated from outside via a blower 11 and conducted via a supply air duct 5 into a first process air duct 4. From the first process air duct 4 the fresh process air (also referred to as "supply air") flows via a heating device 3 onward to the inlet 23 of the drum 2. In the embodiment variant shown in FIG. 1 there is located between the heating device 3 and the drum in the first process air duct 4 a first temperature sensor 13 between the heating device 3 and the drum 2, a device 12 embodied as a flap device for generating a heat buildup, and a second temperature sensor 25. The second temperature sensor 25 regularly measures the temperature of the process air at predetermined time intervals and supplies the measured value to the program controller 17.

In FIG. 1, the arrows show the flow direction of air in a mode of operation provided for standard operating conditions, i.e. normal operation of the vented dryer 1. During said normal operation of the vented dryer the warm air coming from the heating device 3 (referred to in the first and second process air duct as "process air") forces the flap device 12 away from the first temperature sensor 13 in the direction of a wall 28 of the first process air duct 4. The flap device 12 is connected to the wall 28 via a hinge mechanism 14. The heated process air can thus flow freely and initially traverses the drum 2. Next, the then moisture-laden warm process air at the drum outlet 24 flows through a second process air duct 8 in which firstly a second lint filter 26 is located. The process air flows onward through the second process air duct 8 which, in the embodiment variant shown in FIG. 1, splits into a recirculated air duct 7 and an exhaust air duct 9. Other embodiment variants are conceivable in which in particular a recirculated air duct is omitted. According to FIG. 1, part of the process air from the drum 2 thus arrives via the exhaust air duct 9 at an exhaust air outlet 27, from where the process air flows as exhaust air into the room in which the vented dryer is installed or into an exhaust air system that is not shown here. In this embodiment variant the rest of the process air flows through the recirculated air duct 7, in which a lint trap 29 is disposed, via the blower 11 and the heating device 3 back into the drum 2. The vented dryer 1 of this embodiment variant thus operates with a proportion of recirculated air in accordance with the exhaust air principle. In the embodiment variant of the vented dryer according to the invention shown in FIG. 1 the relative proportions of supply air and recirculated air can be set via a first valve 15 (in this case embodied as a flap) in the supply air duct 5 and a second valve 16 (in this case likewise embodied as a flap) in the recirculated air duct 7.

If said process sequence provided for normal operating conditions is disrupted due to the occurrence of a counter-flowing air flow, process air flows from the drum 1 in the direction of the heating device 3. The device (flap device) 12 is deflected through rotation about the hinge mechanism 14, with the result that the supply air aspirated from a supply air inlet 22, after being heated by the heating device 3, cannot flow any further and accumulates in front of the device 12. This leads to a heat buildup which can be registered by the first temperature sensor 13 so that suitable remedial measures (e.g. switching off the heating device 3 or reducing its heat output) can be initiated automatically or manually.

Figure 2:
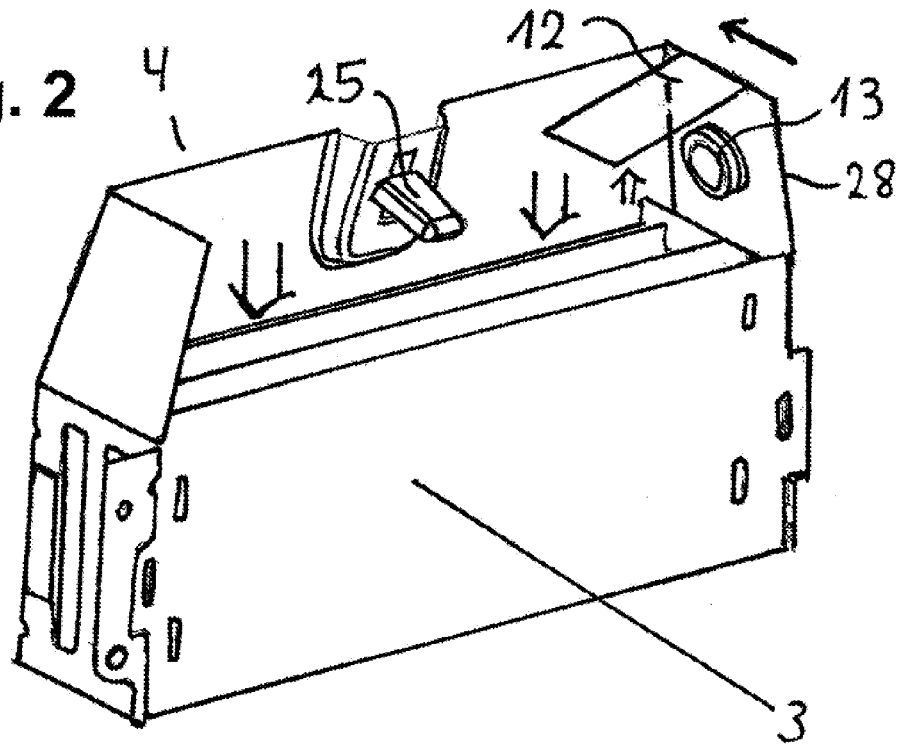
FIG. 2 shows a detail from the vented dryer of FIG. 1 in which the relevant part of a first process air duct can be seen.

FIG. 2 shows a detail from the vented dryer of FIG. 1 in which the relevant part of a first process air duct 4 can be seen. The drawing shows a heating device 3 above which are located in the standard flow direction of the air, i.e. that provided for normal operating conditions, indicated here by two open arrows, a first temperature sensor 13, a device 12 for generating a heat buildup, and a second temperature sensor 25. Reference numeral 28 denotes a wall of the first process air duct 4.

In FIG. 2, the device 12 for generating a heat buildup is shown in a hinged-out state, i.e. in a state following the occurrence of a counter-flowing air current, as a result of which a heat buildup is produced at the first temperature sensor 13 due to the obstruction of the airflow of the air from the heating device 3. The device 12 is mounted on a wall 28 of the first process air duct 4.

The small open arrow shows the obstructed air current from the heating device 3. The two large open arrows show a counter-flowing air current that has resulted in the swinging-out of the device 12. The first temperature sensor 13 can register an increase in the value of the air temperature due to the heat buildup. Reference numeral 25 denotes a second temperature sensor which contributes toward increased operating reliability of the vented dryer.

Figure 3:
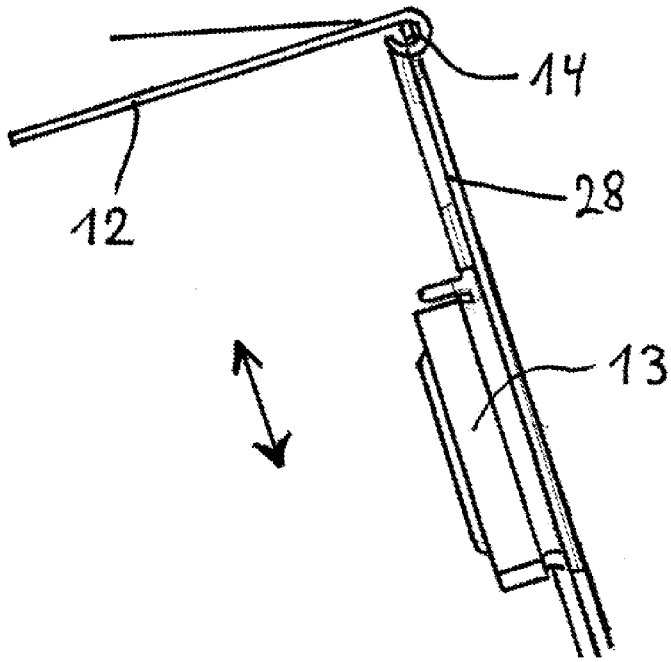
FIG. 3 shows a view of a magnified part of the detail shown in FIG. 2 along the solid arrow drawn in FIG. 2.

FIG. 3 shows a plan view onto a magnified part of the detail from FIG. 2. The plan view is taken along the solid arrow drawn in FIG. 2. The two possible directions of the air current are illustrated by means of a double arrow. It can be seen in FIG. 3 that the device 12 for generating a heat buildup when a counter-flowing air current is present, is bent at one end in order to form a hinge mechanism 14 at a point on the wall 28 of the first process air duct (not shown in further detail here) at which the device 12 is mounted so as to be rotatable. Reference numeral 13 denotes a first temperature sensor 13 which registers a heat buildup generated due to the device 12 being in the hinged-out state.

The invention claimed is:

1. A vented dryer, comprising:

a drum to dry damp laundry by warm process air;

a first process air duct upstream of the drum;

a heater to heat the process air in the first process air duct;

a supply air duct leading into the first process air duct;

an exhaust air duct;

a second process air duct downstream of the drum and transitioning into the exhaust air duct;

a blower;

a first temperature sensor in the first process air duct, and a heat-buildup generator to generate a heat buildup at the first temperature sensor if a counter-flowing air current occurs.

2. The vented dryer of claim 1, wherein the heat-buildup generator is between the heater and the drum.

3. The vented dryer of claim 1, wherein the heat-buildup generator is between the first temperature sensor and the drum.

4. The vented dryer of claim 1, wherein a distance between the heat-buildup generator and the first temperature sensor is in the range from 1 cm to 15 cm.

5. The vented dryer of claim 1, wherein the heat-buildup generator is a flap device.

6. The vented dryer of claim 5, wherein the flap device is mounted by one of a hinge mechanism and a spring mechanism on one of a wall of the first process air duct and at the first temperature sensor.

7. The vented dryer of claim 6, wherein the flap device is mounted by the hinge mechanism on the one of the wall of the first process air duct and at the first temperature sensor.

8. The vented dryer of claim 5, wherein, in a hinged-out state of the flap device, the flap device does not completely close the first process air duct.

9. The vented dryer of claim 1, further comprising a second temperature sensor.

10. The vented dryer of claim 1, further comprising a recirculated air duct having a first end that leads into the first process air duct and a second end that leads leads into the second process air duct.

11. The vented dryer of claim 10, further comprising a lint trap in the recirculated air duct.

12. The vented dryer of claim 1, further comprising an indicator to indicate an occurrence of the counter-flowing air current.

13. A method for operating a vented dryer having a drum to dry damp laundry by warm process air; a first process air duct upstream of the drum; a heater to heat the process air in the first process air duct; a supply air duct leading into the first process air duct; an exhaust air duct; a second process air duct downstream of the drum and transitioning into the exhaust air duct; a blower; a first temperature sensor in the first process air duct, and a heat generator to generate a heat buildup at the first temperature sensor if a counter-flowing air current occurs, the method comprising:

upon occurrence of the counter-flowing air current from the drum in a direction of the heater, obstructing an air flow in the first process air duct by the heat-buildup generator and thereby generating a heat buildup at the first temperature sensor.

14. The method of claim 13, wherein, when a predefined maximum temperature value $T_{max}$ is reached, the first temperature sensor at least one of switches off the heater and indicates the occurrence of a counter-flowing air current by means of an indicator.

* * * * *